US007235925B2

(12) United States Patent
Kwon et al.

(10) Patent No.: US 7,235,925 B2
(45) Date of Patent: Jun. 26, 2007

(54) PLASMA DISPLAY PANEL

(75) Inventors: Jae-Ik Kwon, Asan-si (KR); Kyoung-Doo Kang, Seoul (KR); Tae-Joung Kweon, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 135 days.

(21) Appl. No.: 10/911,552

(22) Filed: Aug. 5, 2004

(65) Prior Publication Data

US 2005/0052136 A1 Mar. 10, 2005

(30) Foreign Application Priority Data

Aug. 5, 2003 (KR) ..... 10-2003-0054059

(51) Int. Cl.
*H01J 17/49* (2006.01)

(52) U.S. Cl. ..... 313/583; 313/584; 313/585

(58) Field of Classification Search ..... 313/582–587; 345/37, 41, 60; 315/169.4
See application file for complete search history.

(56) References Cited

U.S. PATENT DOCUMENTS 6,479,932 B1 * 11/2002 Nunomura ..... 313/582
6,531,819 B1 * 3/2003 Nakahara et al. ..... 313/584
2003/0122486 A1 * 7/2003 Yabe ..... 313/582
2005/0093449 A1 * 5/2005 Su et al. ..... 313/584

FOREIGN PATENT DOCUMENTS

JP 04-036931 2/1992
KR 1999-0033201 5/1999

* cited by examiner

*Primary Examiner*—Mariceli Santiago
*Assistant Examiner*—Anne M Hines
(74) *Attorney, Agent, or Firm*—H.C. Park & Associates, PLC

(57) ABSTRACT

A plasma display panel includes first and second substrates facing each other, discharge sustain electrodes formed on the first substrate, and address electrodes formed on the second substrate. Barrier ribs are disposed between the first and second substrates to form a plurality of discharge cells. A phosphor layer is formed at each discharge cell. The discharge sustain electrode has first bus electrode portions spaced apart from each other by a certain distance, second bus electrode portions at least partially separated from the first bus electrode portions while being electrically connected thereto, and transparent electrodes not overlapped with the second bus electrode portions but being electrically connected to the first bus electrode portions. Interconnection electrodes are arranged over the barrier ribs to interconnect the first and second bus electrode portions.

16 Claims, 7 Drawing Sheets

PLASMA DISPLAY PANEL

This application claims the benefit of Korean Patent Application No. 2003-0054059, filed on Aug. 5, 2003, which is hereby incorporated by reference for all purposes as if fully set forth herein.

BACKGROUND OF THE INVENTION

1. Field of the Invention

The present invention relates to plasma display panels, and in particular, to a bus electrode formed on a front substrate of a plasma display panel.

2. Discussion of the Related Art

A plasma display panel (PDP), recognized as a wide and high quality display device, expresses natural gray scales, and realizes excellent color representation, short response time, and large-scaled dimensions.

FIG. 5 is an exploded perspective view of a plasma display panel, and FIG. 6 is a plan view of an electrode structure formed at a front substrate of the plasma display panel.

The plasma display panel as shown in FIG. 5 includes two sheets of front and rear transparent glass substrates 1 and 2 facing each other, a plurality of stripe-shaped parallel transparent electrodes 3 formed on the inner surface of the front substrate, and a bus electrode 4, formed along the longitudinal side of each transparent electrode 3, with a width smaller than the transparent electrode. A transparent dielectric layer 5 covers the transparent electrodes 3 and the bus electrodes 4, and a transparent protective layer 6 is formed on the dielectric layer 5 with magnesium oxide (MgO).

Additionally, a plurality of stripe-shaped address electrodes 7, orthogonal to the transparent electrodes 3, is formed on the inner surface of the rear substrate 2. A highly reflective dielectric layer 8 covers the address electrodes 7, and a plurality of barrier ribs 9 is formed on the dielectric layer 8. The barrier ribs 9 are formed between the address electrodes 7, while proceeding parallel thereto, thereby forming groove-shaped discharge cells 10. Red, green, and blue phosphors 11 are formed in the discharge cells 10.

The PDP is assembled by facing the two glass substrates 1 and 2 towards each other, injecting a gas mixture such as Ne—Xe or He—Xe into the discharge cells 10, and sealing the peripheries of the substrates 1 and 2 with glass frit.

The transparent electrodes 3 are formed with a transparent conductive material such as indium tin oxide (ITO) or $SnO_2$, and the bus electrodes 4 are formed with a material such as Ag or Cr—Cu—Cr, which have a sheet resistance lower than that of ITO or $SnO_2$. As a result, the bus electrode 4 lowers the resistance of the transparent electrode 3, thereby enhancing its conductivity.

With a PDP structured as above, the transparent electrodes 3, the bus electrodes 4, and the address electrodes 7 are drawn to the outside of the substrates 1 and 2, and voltages are selectively applied to the terminals connected thereto in order to permit discharging within the relevant discharge cells 10. This discharging excites the phosphors 11 to generate visible rays, thereby displaying the desired images.

PDP quality depends upon several factors including the characteristics of brightness and contrast. Contrast is further classified as dark-room contrast and bright-room contrast. Considering that users commonly operate PDPs in a bright environment, bright-room contrast substantially affects image quality.

For this reason, much effort has been made to enhance the PDP's bright room contrast. For example, black colored bus electrodes may be formed on the transparent electrodes to try to darken the bus electrodes and improve the contrast.

However, in this case, transparent electrodes are between the bus electrodes and the user, which requires the user to look through the transparent electrodes to see the bus electrodes. The transparent electrode, therefore, obstructs the user's view of the darkened bus electrode, so that the color of the bus electrode is not clearly seen, which negatively impacts the capability of the colored bus electrode to control bright room contrast.

Additionally, external light (natural light or artificial light) may enter the PDP's front substrate and reflect off of the transparent electrode. In this instance, the reflected light may also obstruct the viewer from clearly seeing the color of the bus electrode, thereby limiting the bus electrode's capability to control bright room contrast.

SUMMARY OF THE INVENTION

Accordingly, the present invention is directed to a PDP that substantially obviates one or more of the problems due to limitations and disadvantages of the related art.

The present invention provides an enhanced contrast characteristic of a PDP by improving the bus electrode structure.

Additional features and advantages of the invention will be set forth in the description which follows, and in part will be apparent from the description, or may be learned by practice of the invention.

To achieve these and other advantages and in accordance with the purpose of the present invention, as embodied and broadly described, the PDP is comprised of first and second substrates facing each other, with discharge sustain electrodes are formed on the first substrate. The discharge sustain electrodes are further comprised of darkened portions of bus electrodes that supply voltage to transparent electrodes, but are not overlapped by the transparent electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Reference will now be made in detail to an embodiment of the present invention, example of which is described below.

Figure 1:
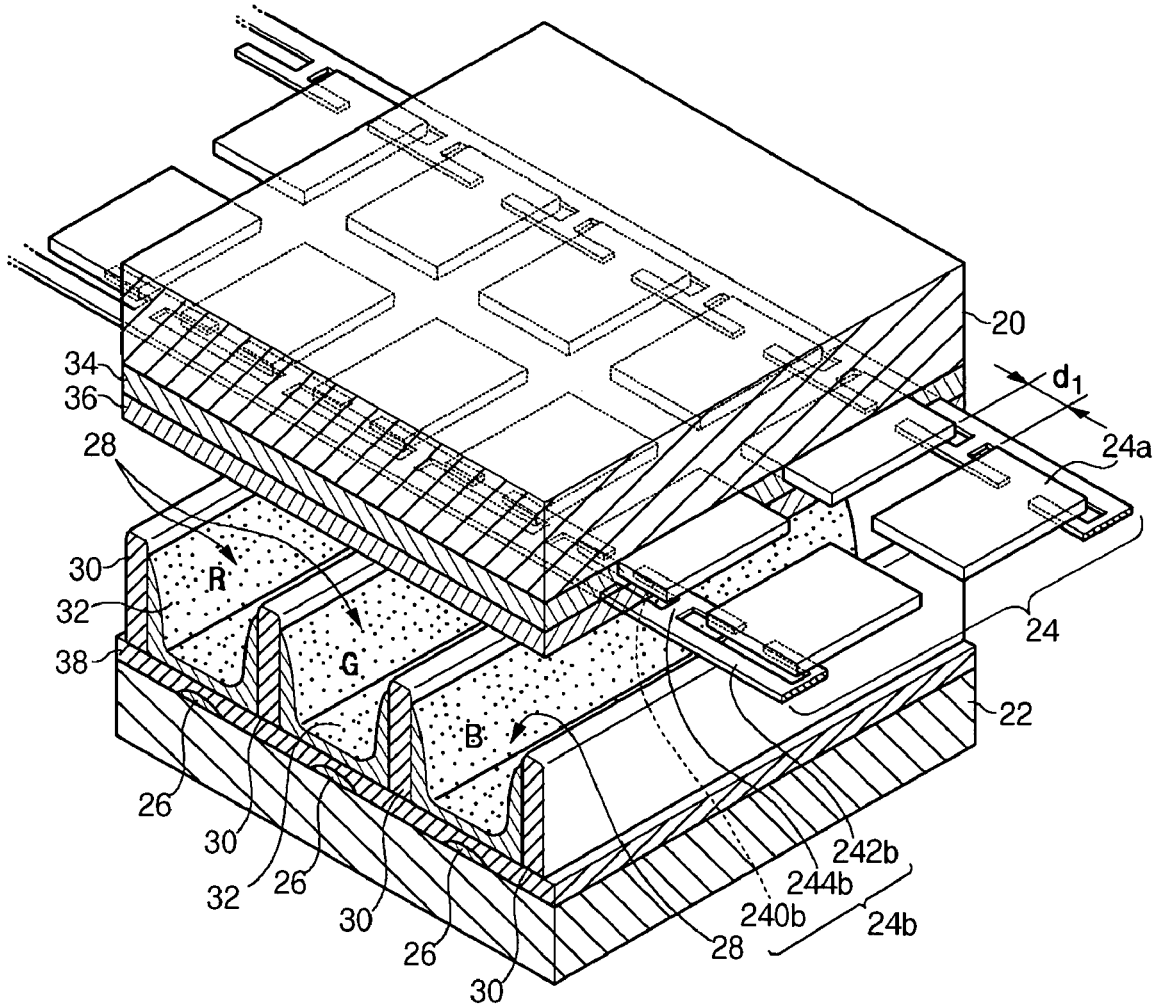
FIG. 1 shows a partial exploded perspective view of a PDP according to an exemplary embodiment of the present invention.
Figure 2:
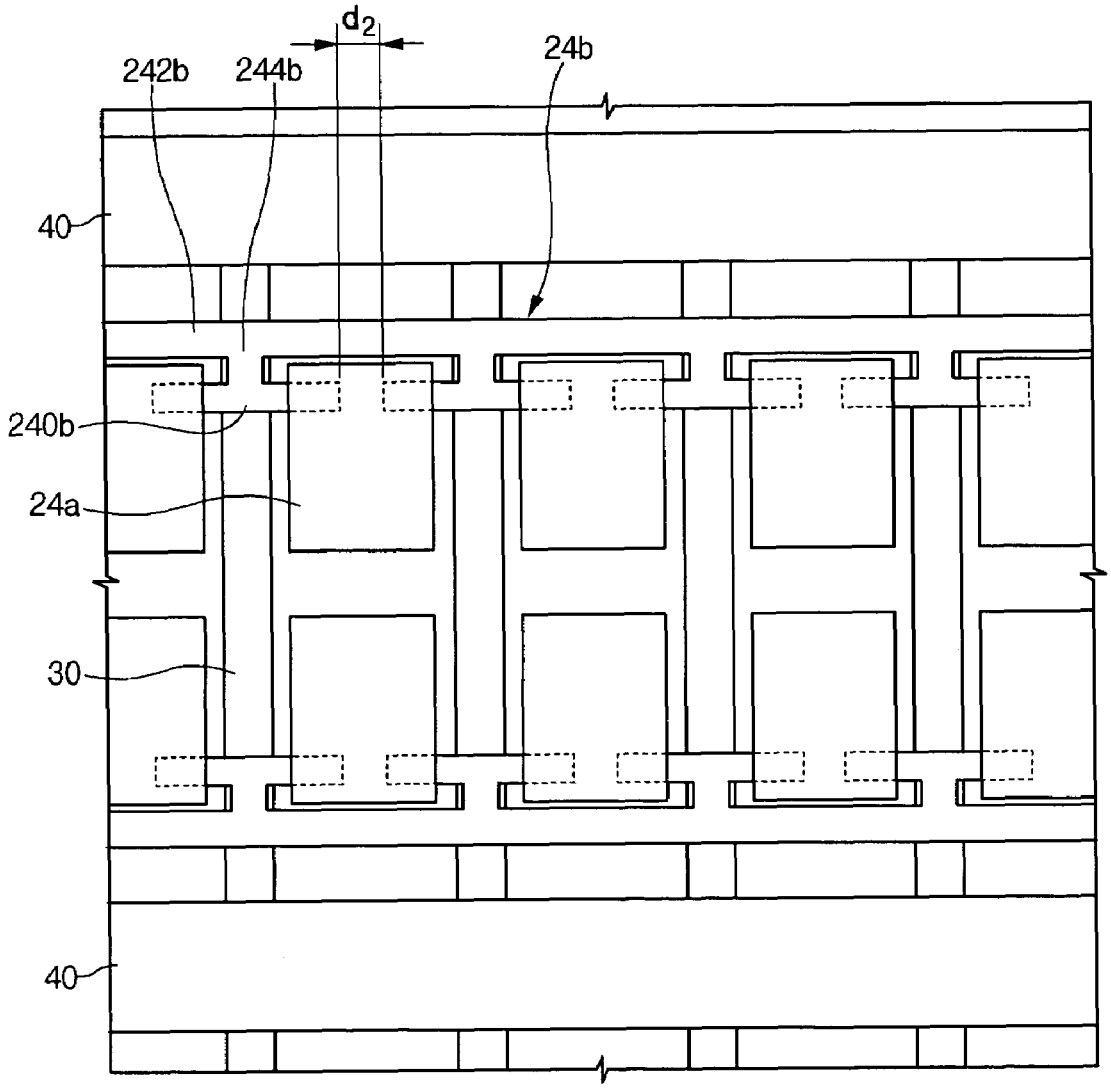
FIG. 2 shows a partial plan view of a front substrate for the PDP shown in FIG. 1.

FIG. 1 shows a partial exploded perspective view of a PDP according to an exemplary embodiment of the present invention, and FIG. 2 shows a partial plan view of a front substrate for the PDP shown in FIG. 1.

As shown in FIGS. 1 and 2, the PDP has first and second transparent glass substrates 20 and 22 facing each other, where the first substrate 20 is a front substrate, and the second substrate 22 is a rear substrate. A discharge mechanism for creating the desired images is interposed between them.

Discharge sustain electrodes 24 are formed on the first substrate 20, and address electrodes 26 are formed on the second substrate 22. Barrier ribs 30, formed on a second dielectric layer 38, are interposed between the first and second substrates 20 and 22, thereby forming a plurality of discharge cells 28. Phosphor layers 32 are formed on the lateral sides of the barrier ribs 30 and the top surface of the dielectric layer 38 with red (R), green (G), and blue (B) phosphors.

A first dielectric layer 34 covers the discharge sustain electrodes 24, and a protective layer 36 is formed on the first dielectric layer 34. The second dielectric layer 38 covers the second substrate 22 and the address electrodes 26.

The stripe-shaped barrier ribs proceed longitudinally along the second substrate 22. The striped-shaped address electrodes 26 also proceeding longitudinally along the second substrate 22, but they are arranged between the barrier ribs 30.

The discharge sustain electrodes 24 are orthogonal to the address electrodes 26, and they comprise transparent electrodes 24*a* and non-transparent bus electrodes 24*b*. The transparent electrodes 24*a* are typically formed with ITO or other similar substances, and the non-transparent bus electrodes 24*b* are formed utilizing a metallic material.

The transparent electrodes 24*a* are structured as a pair of electrode portions facing each other within the discharge cell 28, and the bus electrodes 24*b* are electrically coupled to the transparent electrodes 24*a*.

In this exemplary embodiment, the longitudinal distance between adjacent transparent electrodes 24*a* is distance d1, and d1 is set to a distance whereby the transparent electrodes 24*a* are arranged over the discharge cells 28.

The bus electrode 24*b* has a first bus electrode portion 240*b*, directly connected to the transparent electrode 24*a*, and a second bus electrode portion 242*b*, which does not overlap with the transparent electrode 24*a*. The first and second bus electrode portions 240*b* and 242*b* are separated from each other, and electrically connected to each other, by the interposed interconnection electrode portion 244*b*. The interconnection electrodes 244*b* are arranged so that they are located over the barrier ribs 30. The distance between adjacent first bus electrode portions 240*b* on the transparent electrode 24*a* is distance d2.

A black stripe line 40 is provided in the PDP to realize the basic contrast.

With the PDP exemplified above, the first and second substrates 20 and 22 are combined with each other such that the barrier ribs 30 are arranged between them. After filling the discharge cells with discharge gas, the relevant discharge cells are selectively driven per the input voltages of the address electrodes 26 and the discharge sustain electrodes 24, thereby displaying the desired images.

As shown in the exemplary embodiment above, the PDP with the present invention may have enhanced contrast while displaying the desired images utilizing the basic PDP discharge mechanism.

These benefits are realized because the voltages required for initiating and maintaining the discharging are adequately supplied to the transparent electrodes 24*a* within the discharge cells 28 via the first bus electrode portions 240*b*, while contrast control is made via the second bus electrode portions 242*b* based on their non-transparent color.

Also, because the second bus electrode portions 242*b* are not overlapped by the transparent electrodes 24*a*, the second bus electrode portion's darkened color is not shadowed by the transparent electrode 24*a*, but is clearly visible to the viewer. This results in enhanced PDP contrast.

Additionally, because the first bus electrode portion 240*b* with the transparent electrode 24*a* is contacted separately to form a space therebetween in the discharge cell 28, the first bus electrode portion 240*b* does not intercept the visible rays generated via the transparent electrode 24*a* in the discharge cell 28, but transmits them due to its intrinsic structure, thereby enhancing the brightness and the display efficiency.

As shown by the exemplary embodiment above, a PDP's contrast can be enhanced by improving the structure of the bus electrode.

Furthermore, the structure of the bus electrode (not linearly connected, but intermittently cut) within the discharge cell may further enhance the PDP's brightness. Additionally, when discharging occurs within the discharge cell, the bus electrode structure may limit the amount of discharge current, thereby reducing the PDP's power consumption while enhancing the light emission efficiency thereof.

Figure 3:
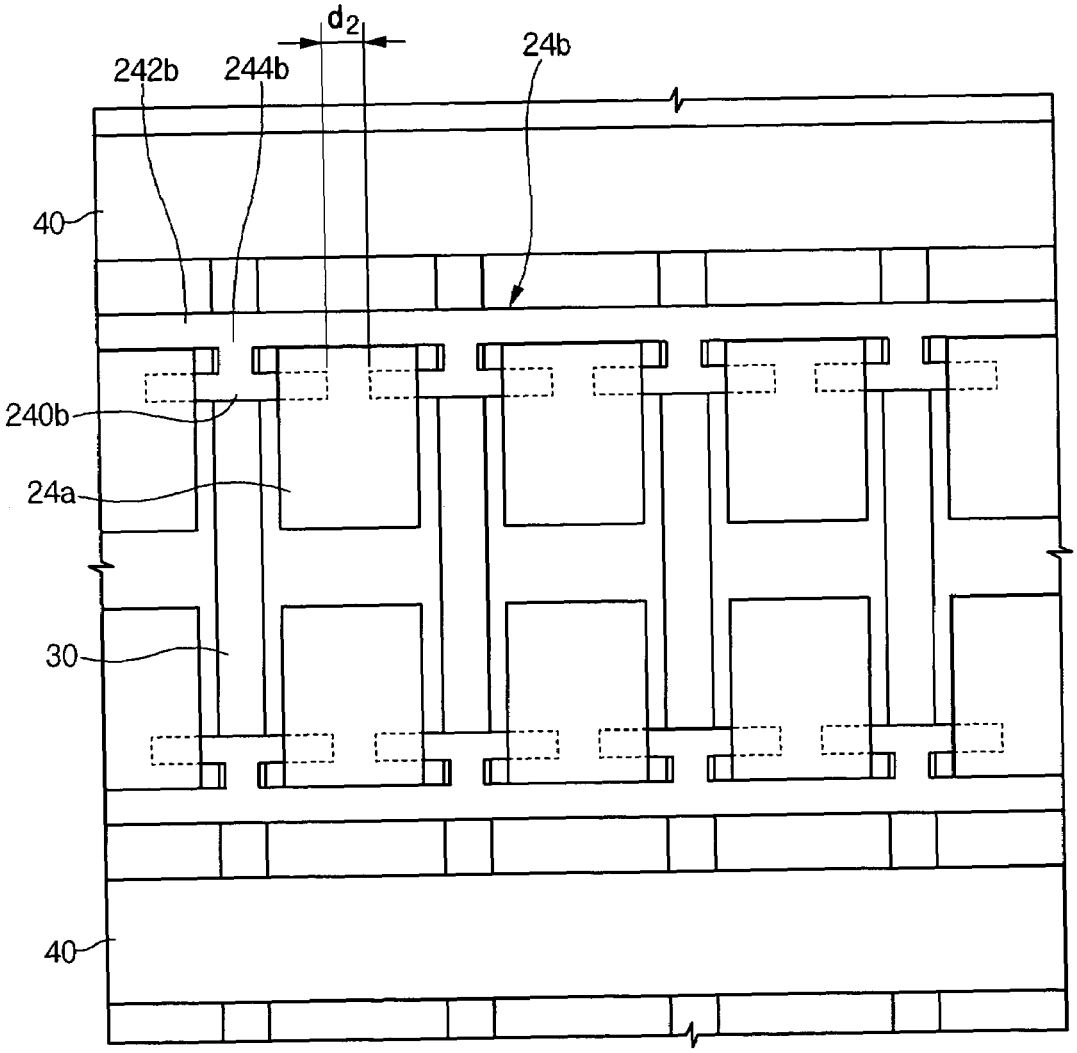
FIG. 3, FIG. 4A, and FIG. 4B show partial plan views of PDP discharge sustain electrodes according to other exemplary embodiments of the present invention.

FIG. 3, which illustrates a partial plan view of PDP discharge sustain electrodes, shows another aspect of the exemplary embodiment of the present invention. As shown in FIG. 3, the transparent electrode 24*a* may be connected to the bus electrode 24*b*, without overlapping it, such that the one-sided end thereof contacts the one-sided end of the second bus electrode portion 242*b* (directed toward the transparent electrode).

Figure 4A:
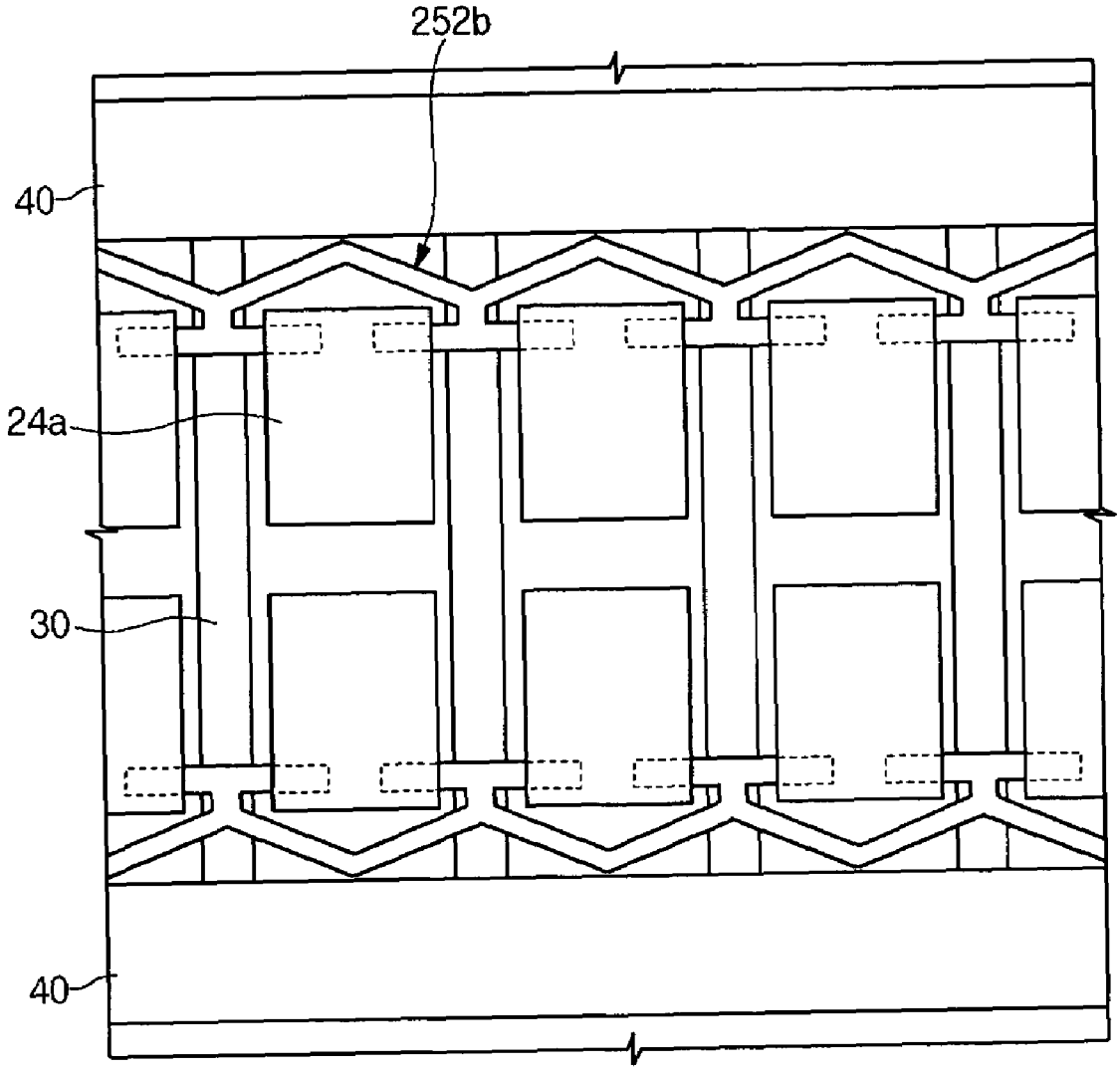
Figure 4B:
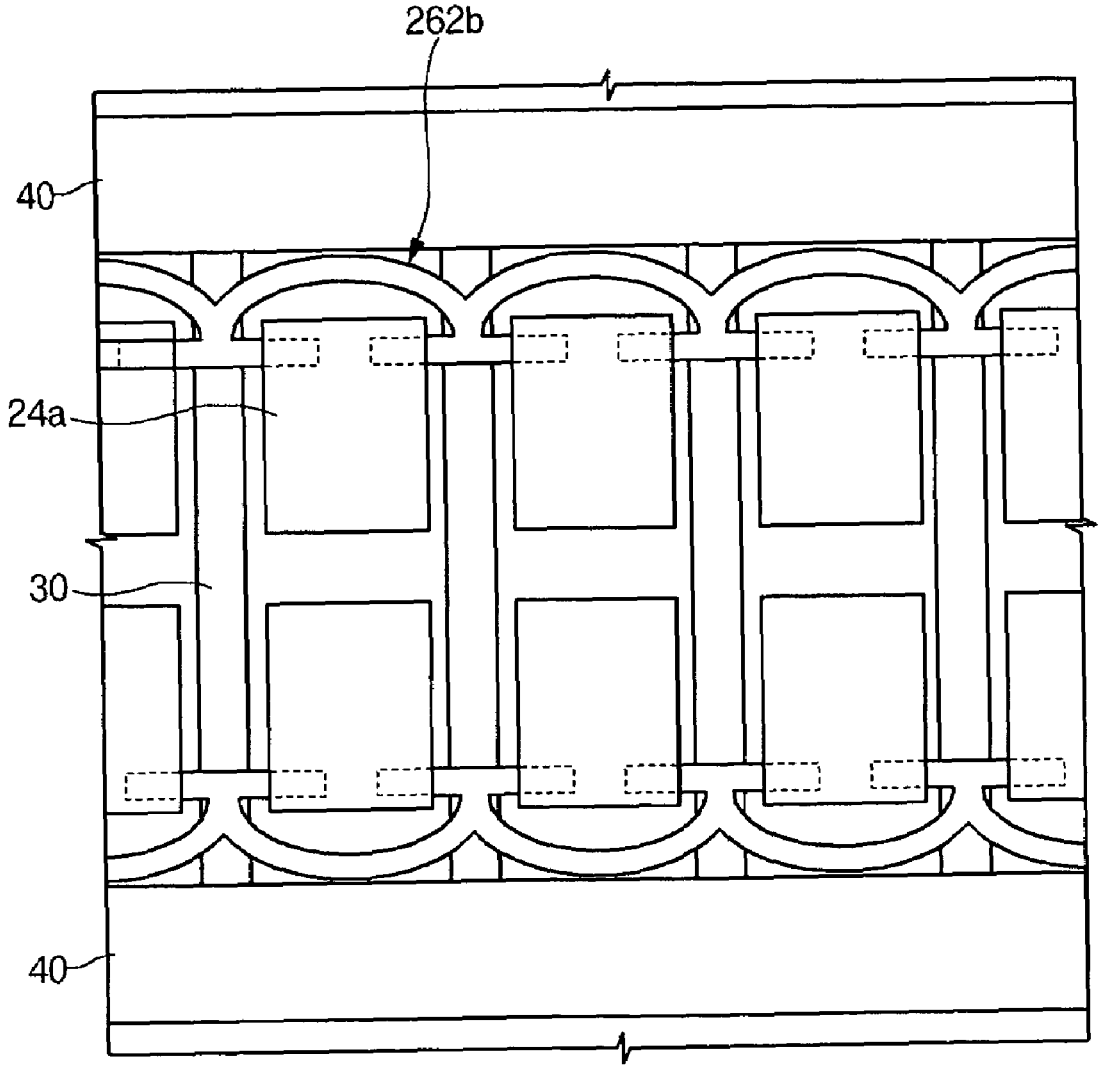

FIG. 4A and FIG. 4B, which illustrate partial plan views of PDP discharge sustain electrodes, show other aspects of the exemplary embodiment of the present invention. As shown in FIG. 4A and FIG. 4B, the second bus electrode portion 252*b* and 262*b*, respectively, may be bent, rounded, or patterned otherwise.

Figure 4C:
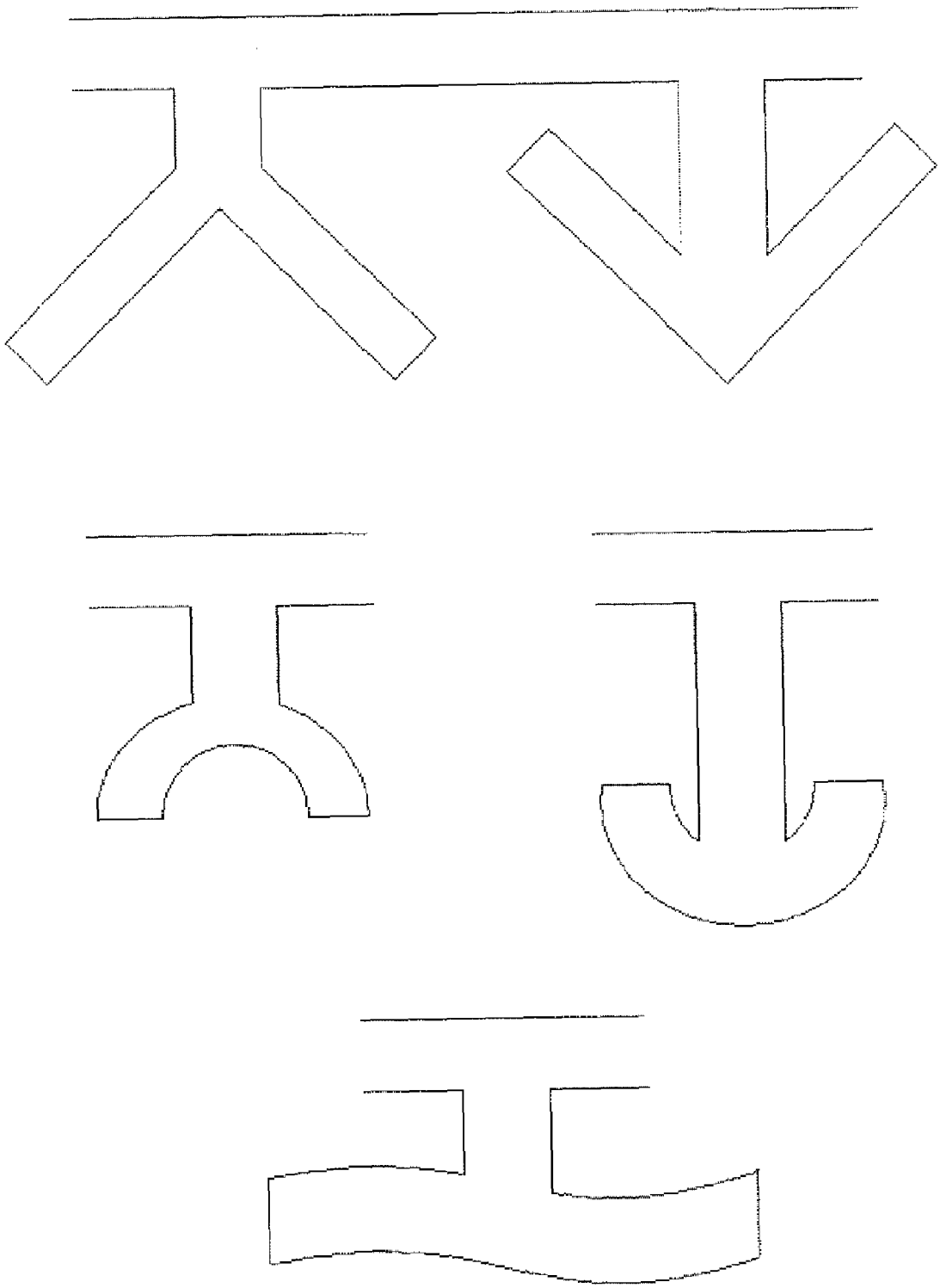
FIG.4C shows partial plan views of first bus electrode portions PDP discharge sustain electrodes according to other exemplary embodiments of the present invention.
Figure 5:
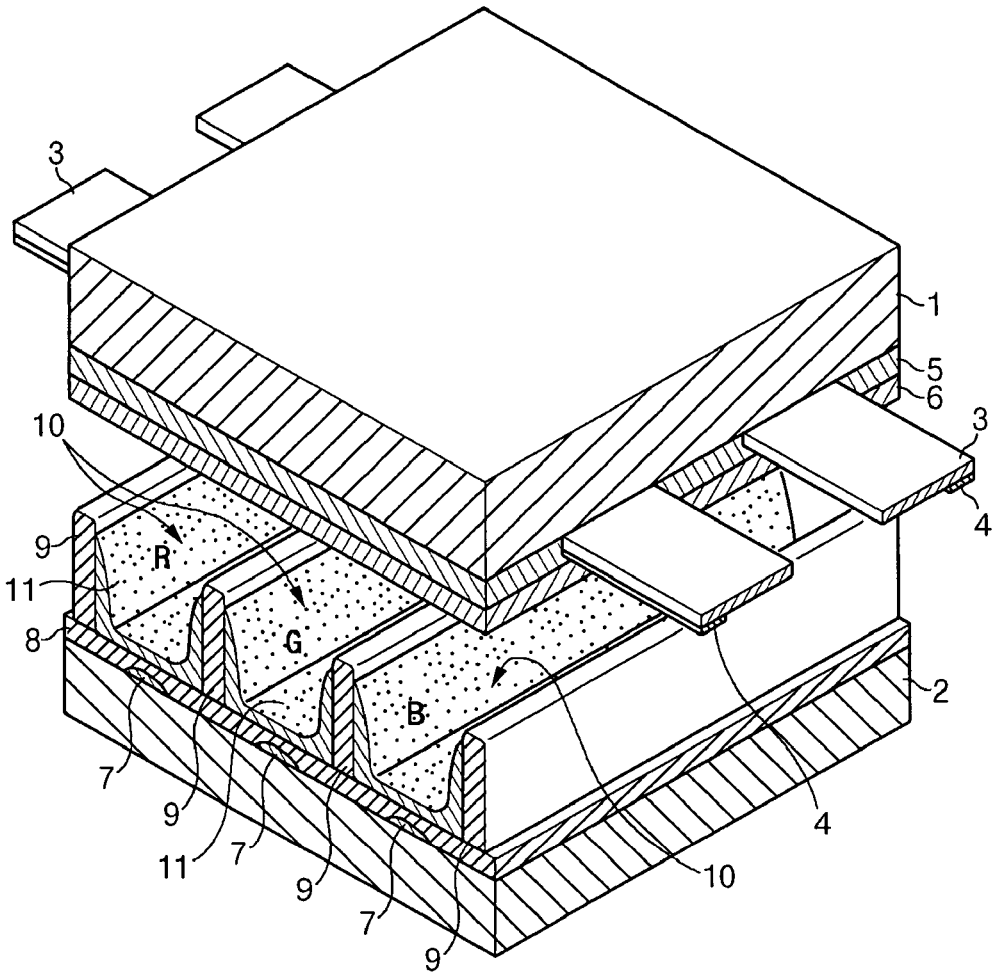
FIG. 5 shows a partial exploded perspective view of a PDP according to a prior art.
Figure 6:
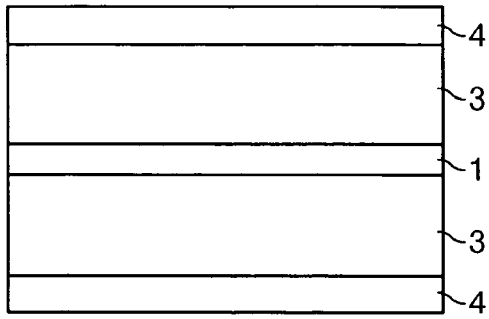
FIG. 6 shows a partial plan view of a discharge sustain electrode for the PDP shown in FIG. 5.

Similarly, the first bus electrode portion 240*b* need not be parallel to the second bus electrode portion 242*b*. For example, as shown in the exemplary embodiments, the interconnection electrode portion 244*b* and the first bus electrode portion 240*b* are formed together in the shape of a "T". However, embodiments of the present invention could include other formations between the interconnection electrode portion 244*b* and the first bus electrode portion 240*b* such as a "Y", where the first bus electrode portion 240*b* portion is shaped as a "V" at the end of the interconnection electrode portion 244*b*. Similarly, the first bus electrode portion 240*b* could be shaped any shape, including "V", a concave curve, a convex curve, a sinusoidal curve, or a linear shape disposed at an oblique angle with respect to the second bus electrode portion 242*b* as shown in FIG. 4C.

While the exemplary embodiments discussed thus far show each adjacent formation of the interconnection electrode portion 244*b* and the first bus electrode portion 240*b* as identical, the present invention does not require it. For example, these formations may be comprised of alternating shapes, such that each "T" formation is adjacent to a "Y" formation and vice versa. These formations may also be comprised of a plurality of shapes.

These exemplary embodiments noted above may be used when the transparent electrode 24*a* does not touch the second bus electrode portion 242*b* and when the transparent electrode 24*a* is connected to the bus electrode 24*b* such that the one-sided end thereof contacts the one-sided end of the second bus electrode portion 242*b* (directed toward the transparent electrode).

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate and a second substrate facing each other;

a plurality of discharge cells defined by barrier ribs disposed between the first substrate and the second substrate; and discharge sustain electrodes formed on the first substrate, wherein a discharge sustain electrode comprises:

a plurality of first bus electrode portions disposed in a row of discharge cells;

a second bus electrode portion;

a plurality of interconnection electrodes directly connecting the first bus electrode portions with the second bus electrode portion; and a plurality of transparent electrodes disconnected from each other, wherein each transparent electrode is directly connected to two first bus electrode portions, each first bus electrode portion is directly connected to the second bus electrode portion, and the second bus electrode portion is separated from the transparent electrodes without overlap.

2. The PDP of claim 1, wherein the transparent electrodes are electrically coupled to the second bus electrode portion through the first bus electrode portions.

3. The PDP of claim 2, wherein an interconnection electrode is arranged over a barrier rib to connect a first bus electrode portion and the second bus electrode portion.

4. The PDP of claim 3, wherein a one-sided end of a transparent electrode contacts a one-sided end of a first bus electrode portion.

5. The PDP of claim 3, wherein the first bus electrode portion is formed at an end of the interconnection electrode in the shape of a stripe and is disposed parallel to the second bus electrode portion.

6. The PDP of claim 3, wherein the first bus electrode portion is formed at an end of the interconnection electrode in the shape of a stripe, where the stripe is not parallel to the second bus electrode portion.

7. The PDP of claim 3, wherein the first bus electrode portion is formed at an end of the interconnection electrode in a shape of a "V".

8. The PDP of claim 3, wherein the first bus electrode portion is formed at an end of the interconnection electrode in a shape of an inverted "V".

9. The PDP of claim 3, wherein the first bus electrode portion is formed at the end of the interconnection electrode in a shape of a concave curve.

10. The PDP of claim 3, wherein the first bus electrode portion is formed at the end of the interconnection electrode in a shape of a convex curve.

11. The PDP of claim 3, wherein the first bus electrode portion is formed at the end of the interconnection electrode in a shape of a sinusoidal curve.

12. The PDP of claim 3, wherein adjacent first bus electrode portions are formed in different shapes.

13. A plasma display panel (PDP) bus electrode, comprising:

a plurality of first bus electrode portions disposed in a row of PDP discharge cells;

a second bus electrode portion; and a plurality of transparent electrodes disconnected from each other, wherein each transparent electrode is directly connected to two first bus electrode portions, said two first bus electrode portions are directly connected to the second bus electrode portion, and the second bus electrode portion is not overlapped by a transparent electrode.

14. The PDP bus electrode of claim 13, wherein an interconnection portion of the bus electrode electrically connects the second bus electrode portion of the bus electrode with a darkened surface to a portion of the first bus electrode portion that is overlapped by a transparent electrode.

15. A plasma display panel (PDP), comprising:

a first substrate and a second substrate facing each other; and discharge sustain electrodes formed on the first substrate, wherein the discharge sustain electrodes comprise:

means for supplying voltages; and means for discharging, wherein the means for discharging is transparent, and wherein means for supplying voltages comprises:

a plurality of first bus electrode portions disposed in a row of discharge cells;

a second bus electrode portion directly connected with each first bus electrode portion; and means for electrically coupling with the means for discharging that overlaps with the means for discharging, wherein each transparent electrode is directly connected to two first bus electrode portions and the second bus electrode portion does not overlap with the means for discharging, and the means for electrically coupling with the means for discharging that overlaps with the means for discharging is formed in different shapes.

16. The PDP of claim 15, wherein a one-sided end of the means for discharging contacts a one-sided end of the means for enhancing contrast ratio that does not overlap with the means for discharging.

* * * * *